US005377768A

United States Patent [19]

Smith

[11] Patent Number: 5,377,768

[45] Date of Patent: Jan. 3, 1995

[54] TOOL FOR DRIVING A TUBULAR STAKE

[76] Inventor: R. Michael Smith, 404 Western Ave., Apt. 1, Joliet, Ill. 60435

[21] Appl. No.: 134,463

[22] Filed: Oct. 8, 1993

Related U.S. Application Data

[63] Continuation of Ser. No. 983,653, Dec. 1, 1992, abandoned.

[51] Int. Cl.[6] ..... E02D 7/04

[52] U.S. Cl. ..... 173/90; 405/232; 72/479

[58] Field of Search ..... 173/90, 91; 405/253, 405/255, 231, 232; 72/393, 479; 175/19

[56] References Cited

U.S. PATENT DOCUMENTS

| | | | |
|---|---|---|---|
| 485,692 | 11/1892 | Harrington | 72/479 |
| 672,884 | 4/1901 | Bennett | 72/479 |
| 1,283,799 | 11/1918 | Kerr | 72/479 |
| 1,319,696 | 10/1919 | Davidson | 72/479 |
| 4,029,158 | 6/1977 | Gerrish | 405/232 |
| 5,002,432 | 3/1991 | Dysarz | 405/232 |

*Primary Examiner*—Scott A. Smith
*Attorney, Agent, or Firm*—Potthast & Ring

[57] ABSTRACT

A tool is presented which includes a shaft portion for insertion into a tubular stake; a head portion for receiving and conveying an applied impact; and a flaring portion intermediate the shaft portion and the head portion for contacting the upper edge of the tubular stake to force it downward during the applied impact and to flare the upper edge thereof.

5 Claims, 2 Drawing Sheets

TOOL FOR DRIVING A TUBULAR STAKE

This application is a continuation of application Ser. No. 07/983,653, filed Dec. 1, 1992 now abandon.

BACKGROUND OF THE INVENTION

1. Field of the Invention

The present invention relates generally to landscaping equipment and tools used therewith, and more particularly relates to tools used to drive or transmit driving forces to spikes, stakes and the like.

1. Description of the Prior Art

Landscape timbers are typically being held in place by spikes or the like which employ a protruding head portion to hold down the timber. Nevertheless, a need has arisen for an inexpensive yet aesthetic staking method, and an insertion tool therefor, which is effective to secure the timbers but eliminates the protruding head portion of the stake.

SUMMARY OF THE INVENTION

The tool of the present invention accomplishes the above objective by effectively transmitting driving forces to a tubular stake to insert the stake through a landscape timber and into the ground at the same time the head of the stake is flared and is driven below the surface of the timber. This tool comprises a lower shaft portion for insertion into the tubular stake; an upper head portion for receiving and conveying an applied impact; and a contacting and flaring portion intermediate the lower shaft portion and the upper head portion for contacting the upper edge of the tubular stake to force the tubing downward during the applied impact and simultaneously flaring the upper edge of the tubular stake. Additionally, this flaring portion also exhibits a flare limiting stop which blocks further spread of the head of the stake to force the head below the surface of the timber.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Figure 1:
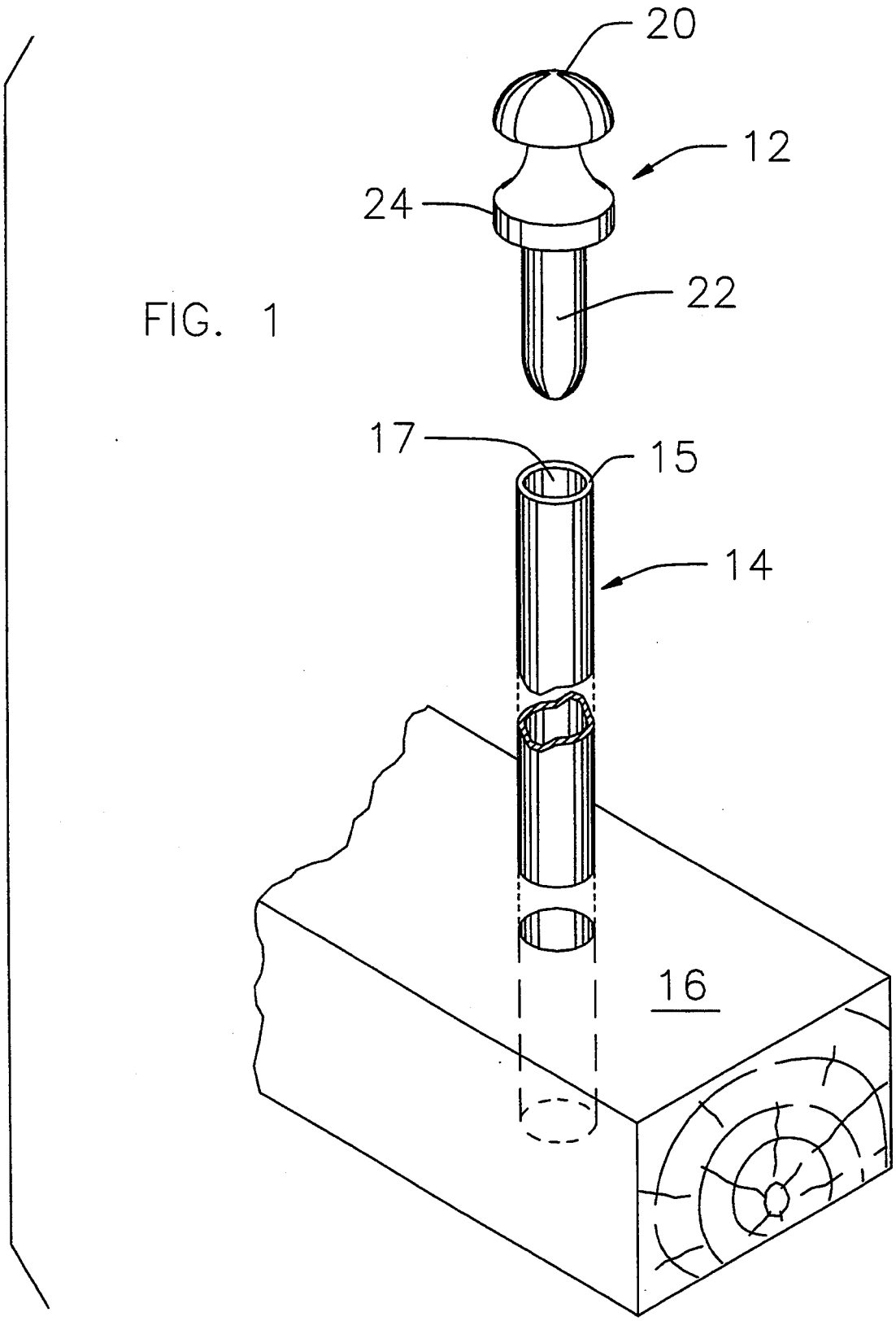
FIG. 1 is a pictorial view of the tool of the present invention positioned above a tubular stake and landscape timber.

Turning first to the exploded view of FIG. 1, the tool 12 of the invention is shown positioned above a tubular stake 14 and a landscape timber 16. This tool is formed to present three functional sections: a head portion 20 for receiving an applied impact; a shaft portion 22 for insertion into the tubular stake; and a flaring portion 24, most clearly shown in FIGS. 2–4. This flaring portion exhibits an asymmetrical annular groove 30 presenting a stop 32 to limit the flaring by blocking further relative movement. In the preferred embodiment this stop 32 forms an abutment comprising an abrupt change in the radius of the annular groove 30 to create an abutment which the flaring head of the stake contacts to prevent further relative motion of the tool within the tubular stake.

Figure 2:
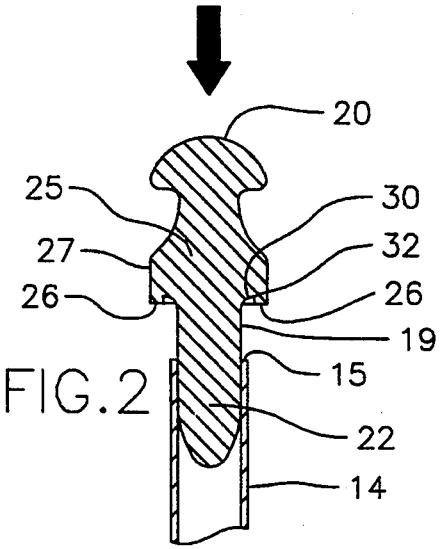
FIG. 2 is a cross-sectional view of the tool of FIG. 1 positioned into the tubular stake, prior to applying driving impact.
Figure 4:
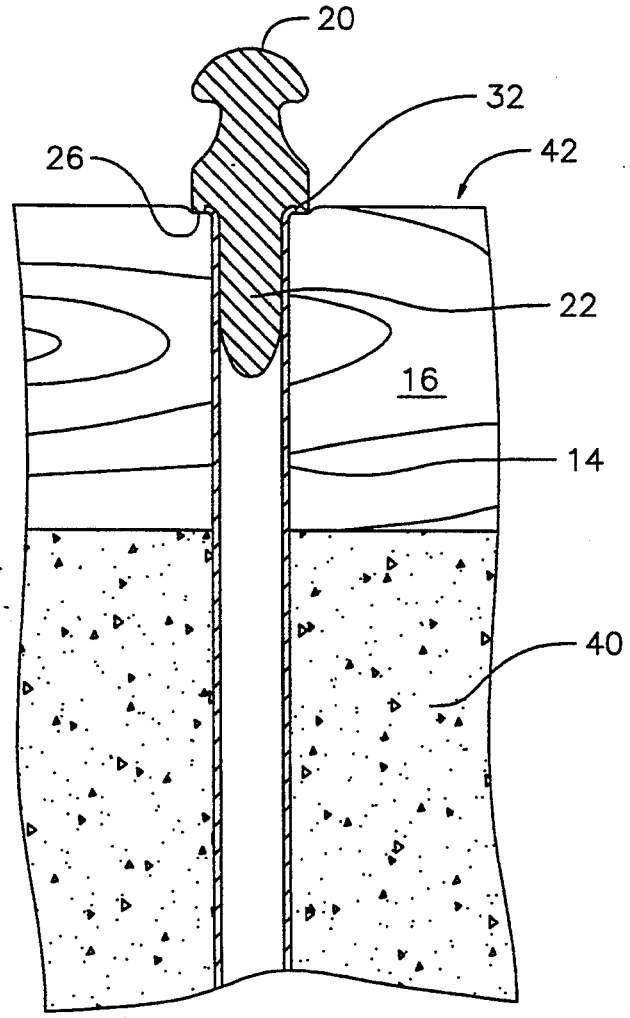
FIG. 4 is a cross-sectional view of the tool, the driven tubular stake and the timber overlying the ground to which it is staked.
Figure 3:
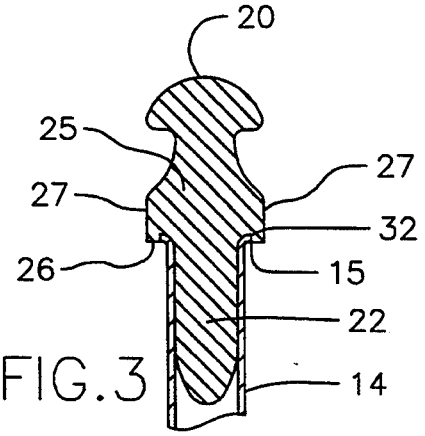
FIG. 3 is a cross-sectional view of the tool of the present invention after applied impact.

Staking of a landscape timber is accomplished by inserting a tubular stake into a predrilled hole of the landscape timber and then positioning the tool into the upper opening of the tubular stake. An applied striking impact drives the tool against the stake which in turn drives the stake into the ground 40 (FIG. 4). Due to the resistance of the ground to the insertion of the stake, the driving impact also causes relative movement of the tool within the stake. As impact is applied the tool first enters the stake (FIG. 2) and ultimately begins to flare the head of the stake (FIG. 3 and FIG. 4). Continued impact on the tool causes the head of the stake to flare outwardly until it reaches the stop 32 of the flaring portion of the tool. Further impact on the tool causes the combined tool and stake to be driven downwardly until the flared end of the stake is driven below the surface 42 of the timber 16 for a clean aesthetic appearance.

Referring again to FIG. 4, the tool 12 is shown driven through the stake 14 carried by timber material 16. The stake 14, FIG. 1, has a circular member 15 which defines a hollow end portion 17 of the stake for receipt of the shaft portion 22 of the tool 12. Referring now to FIGS. 2 and 3, the annular groove 30 is disposed intermediate the shaft portion 22 and the head portion 20 of the tool 12. The annular groove 30 is positioned adjacent to the entire circumferential exterior 19 of the circular shaft portion 22. In response to receipt of the shaft portion 22 into the hollow end portion 17 of the stake 14, the annular groove 30 engages the entire wall member 15 of the stake upon an applied impact to the head portion 20 of the tool 12. The annular groove 30 forms an annular stop wall member 32 which is spaced from the shaft portion 22 to limit flaring of the wall member 15 engaged by the annular groove 30.

Flattening wall member 25 is placed adjacent to the annular stop wall member 32. The flattening wall member 25 has a smooth blunt surface 26 perpendicular to the shaft portion 32 and placed in a transverse position to the annular stop wall member 32. The blunt surface 26 of the flattening wall member 25 engages and compresses the material 16, FIG. 4, through which the stake 14 is driven away from the annular stop wall 32. The blunt surface 26 of the flattening wall member 25 pushes against the material 16 upon receipt of a driving force, rather than cutting into or piercing the material thereby enabling ease in removal of the tool from the material. The flattening wall member 25 has a wall section 27 extending from and transverse in a substantially perpendicular position to the smooth blunt surface of the flattening wall member. The wall section 27 forms an annular surface about the head portion 20 of the tool 12. The annular stop wall member 32 is spaced from the shaft portion 22 at a distance greater than the thickness of one wall member 15 defining the hollow portion 17 of the stake 14 to enable the wall member to flare outward until it abuts with the stop member when the tool 12 is driven into the timber material 16 through the stake.

The features of the present invention are preferably implemented with the tool described above in FIGS. 1-4. Furthermore, the preferred method of driving a stake having a wall member defining a hollow end portion of the stake through a material comprises the steps of:

(1) inserting a shaft portion of a tool for transmitting driving forces to a stake into the hollow end portion of the stake;

(2) engaging the wall member defining the hollow end portion of the stake with an annular groove disposed adjacent to an entire circumferential exterior of the shaft portion in which the annular groove forms an annular stop wall member spaced from the shaft portion to limit flaring of the wall member engaged in the annular groove; and (3) applying a striking force to a head portion of the tool for receiving and transmitting a driving force to the stake engaged in the annular groove and a flaring force to the wall member of the stake and for transmitting a force to a flattening wall member adjacent to the annular stop member in which the flattening wall member has a blunt surface to engage the material adjacent and circumferential about the exterior wall member of the stake.

From the foregoing description, it will be apparent that modifications can be made to the apparatus and method for using same without departing from the teachings of the present invention. Accordingly, the scope of The invention is only to be limited as necessitated by the accompanying claims.

I claim:

1. A tool for transmitting driving forces to a stake having a wall member defining a hollow end portion of the stake in which the stake is driven through a material and in which the tool has a shaft portion for inserting into the hollow end portion of the stake and a head portion for receiving and conveying an applied impact to the stake member, comprising:

an annular groove disposed intermediate the shaft portion and the head portion and adjacent to an entire circumferential exterior of said shaft portion to engage the entire wall member of said hollow end portion of the stake and in which the annular groove forms an annular stop wall member spaced from said shaft portion to limit flaring of the wall member engaged by the annular groove; and a flattening wall member adjacent to said annular stop wall member having a blunt surface positioned substantially transverse to the annular stop wall member and transverse to an axis of said shaft portion to engage and compress the material through which the stake is driven adjacent to and extending away from the annular stop wall member to provide ease in removal of the flattening wall member from the material.

2. The tool for transmitting driving forces to a stake of claim 1 in which the annular stop wall member is spaced from the shaft portion a distance greater than the thickness of the wall member defining the hollow portion of the stake.

3. The tool for transmitting driving forces to a stake of claim 1 in which the blunt surface of the flattening wall member is positioned substantially perpendicular to said shaft portion.

4. The tool for transmitting driving forces to a stake of claim 1 in which the flattening wall member has a wall section extending from and transverse to said blunt surface.

5. The tool for transmitting driving forces to a stake of claim 4 in which the wall section forms an annular surface about said head portion.

* * * * *